US007013934B1

(12) United States Patent
Hicok

(10) Patent No.: US 7,013,934 B1
(45) Date of Patent: Mar. 21, 2006

(54) ADAPTER FOR USE WITH A FUNNEL

(76) Inventor: Gaylen E. Hicok, 2444 Midway Rd., Charles City, IA (US) 50616

( * ) Notice: Subject to any disclaimer, the term of this patent is extended or adjusted under 35 U.S.C. 154(b) by 0 days.

(21) Appl. No.: 11/130,469

(22) Filed: May 16, 2005

(51) Int. Cl.
*B65B 39/00* (2006.01)

(52) U.S. Cl. ..... 141/300; 141/297; 141/340; 141/383

(58) Field of Classification Search ..... 141/297, 141/331–345, 382–386, 300
See application file for complete search history.

(56) References Cited

U.S. PATENT DOCUMENTS

| | | | | |
|---|---|---|---|---|
| 97,742 A | | 9/1869 | Hildebrand | |
| 279,739 A | | 6/1883 | Gifford | |
| 357,476 A | | 2/1887 | Gersdorff | |
| 1,651,963 A | * | 12/1927 | Mooney | 141/297 |
| 1,868,389 A | | 7/1932 | Howard | |
| 2,517,759 A | | 8/1950 | Bentzen | |
| 3,211,195 A | * | 10/1965 | Porter | 141/337 |
| 4,338,983 A | | 7/1982 | Hatcher | |
| 5,123,461 A | * | 6/1992 | Belokin et al. | 141/98 |
| 5,277,234 A | | 1/1994 | Warstler | |
| 5,385,180 A | * | 1/1995 | Wittman | 141/340 |
| 5,479,970 A | * | 1/1996 | Trani | 141/297 |
| 6,119,739 A | | 9/2000 | McGee | |
| 6,260,590 B1 | * | 7/2001 | Ziegmann | 141/332 |

* cited by examiner

*Primary Examiner*—Timothy L. Maust
(74) *Attorney, Agent, or Firm*—Sturm & Fix LLP

(57) ABSTRACT

An adapter is shown for use with a funnel having an upper tapered section and a lower tapered section and a container having a top surface with an opening therein. The adapter has a housing having a top, a bottom, a longitudinal axis, a tapered opening is disposed through the inside housing about the longitudinal axis and an outside portion, the tapered opening being larger at the top thereof than at than at the bottom for telescopically receiving the lower tapered section of the funnel.

7 Claims, 1 Drawing Sheet

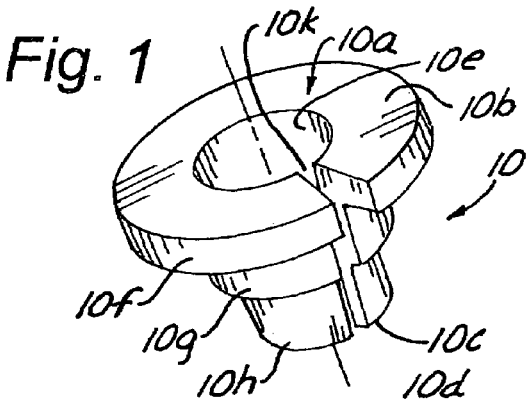
Fig. 1
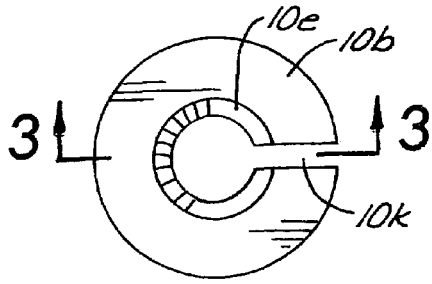
Fig. 2
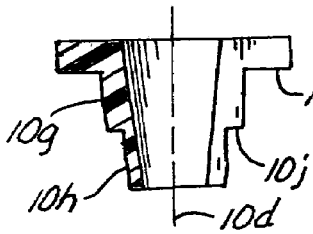
Fig. 3
Fig. 4
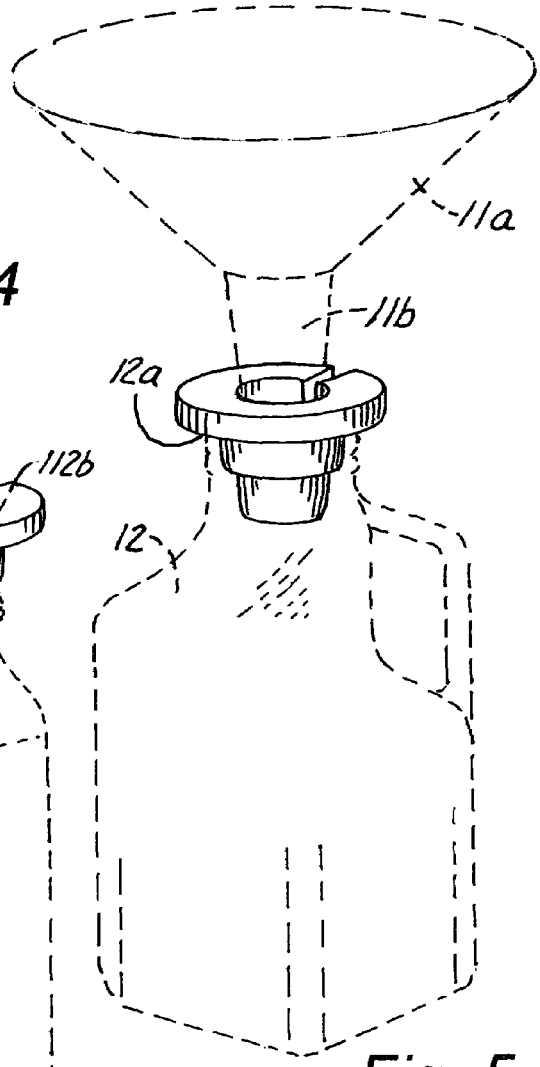
Fig. 6
(PRIOR ART)
Fig. 5

ADAPTER FOR USE WITH A FUNNEL

BACKGROUND OF THE INVENTION

1. Field of the Invention

The present invention relates generally to the use of funnels for transferring liquid from one container to another and more particularly to an adapter for facilitating an easier transfer of the liquid while using a funnel.

2. Description of the Prior Art

Funnels typically have an upper frusto conical portion and a lower frusto conical portion, the lower portion of which is thinner than the upper one. When this lower portion of the funnel is placed into a container in a situation wherein the opening in the container is larger than the lower tapered portion of the funnel, the funnel will not be properly restrained and hence can move around during the transfer of liquid from one container, through the funnel, to another container, for example as shown in FIG. 6.

Another problem with prior art funnels is that when they seal against the top opening of a container, the air will be pushed out of the container and up past the funnel as fluid is being transferred. This action slows the effective transfer of the liquid. Accordingly, there is a need to overcome the aforementioned deficiencies of the prior art.

SUMMARY OF THE INVENTION

The present invention relates to an adapter for use with funnels so that various funnel sizes can be used in containers with various sizes of openings therein and still be stable. An adapter which has multiple step portions thereon can be placed into containers of different sizes so that the adapter will remain stable on the top of the container, i.e. will not shift around. At the same time, a funnel of various sizes can be used to extend into the adapter.

Additionally, a vent structure is provided to use as an air bleed to prevent "burping" of air up past the adapter and funnel during the transfer of liquid from one container, through the funnel and adapter, to another container.

An object of the present invention is to provide an adapter which is useful for various-sized containers and various-sized funnels.

Another object of the present invention is to provide an adapter which has a built-in venting or air bleed structure.

Other objects, advantages, and novel features of the present invention will become apparent from the following detailed description of the invention when considered in conjunction with the accompanying drawings.

BRIEF DESCRIPTION OF THE DRAWINGS

FIG. 1 is a perspective view of an adapter constructed in accordance with the present invention;

FIG. 2 is a top view of the adapter shown in FIG. 1;

FIG. 3 is a partial cross sectional view of the adapter of FIG. 1;

FIG. 4 is a perspective view of the present invention shown in use on a small bottle with a small opening in the top thereof;

FIG. 5 is a perspective view of the present invention shown in a larger container with a larger opening in the top thereof and with the container and funnel shown in dashed lines; and FIG. 6 is a perspective view of the prior art showing how a funnel will flop around in a container where the opening in the top is not sized precisely to cooperate with the funnel itself.

DESCRIPTION OF THE BEST MODE

Referring now to the drawings, where like reference numbers designate identical or corresponding views throughout the several views, FIG. 1 shows a funnel adapter 10 constructed in accordance with the present invention.

An adapter 10 is shown for use with a funnel 11 having an upper tapered section 1*a* and a lower tapered section 11*b* and a container 12 or 112 having a top surface 12*a*, 112*a* with an opening 12*b* or 112*b* respectively therein. The adapter 10 has a housing 10*a* having a top 10*b*, a bottom 10*c*, a longitudinal axis 10*d*, a tapered opening 10*e* is disposed through the inside housing 10*a* about the longitudinal axis 10*d* and an outside portion shown as the outside of at least part of parts 10*f*, 10*g*, or 10*h*, said tapered opening 10*e* being larger at the top thereof than at than at the bottom for telescopically receiving the lower tapered section 11*b* of the funnel 11.

An upper portion 10*f* of the housing 10*a* is disposed radially outwardly farther from the longitudinal axis 10*d* than a lower portion 10*h* of the housing 10*a* is spaced outwardly from the longitudinal axis 10*d*.

An intermediate portion 10*g* of the housing 10*a* is disposed outwardly farther from the longitudinal axis 10*d* than is the lower portion 10*h* of the housing 10*a* but intermediate portion 10*g* is does not extend radially outwardly more than the upper portion 10*f* extends outwardly from the longitudinal axis 10*d*.

A lower part 10*i* of the upper portion 10*f* has a first shoulder 10*i* thereof thereon for abutment with the top surface 12*a* of the container 12 shown in FIGS. 5 and 6 if the opening 12*b* in the top surface 12*a* of the container 12 is smaller than the top portion 10*f* but larger than the lower and intermediate portions 10*h* and 10*g* respectively of the housing 10*a*.

The intermediate portion 10*g* has a second shoulder 10*j* thereon for abutment with the top surface 112*a* of the container 112 if the opening 112*b* in the top surface of the container 112 is smaller than the lower portion 10*h* of the housing 10*a* but larger than the lower portion 10*h* of the housing 10*a*.

The outside of the intermediate portion 10*g* of the housing 10*a* is, in a preferred embodiment, substantially circular in shape and is smaller in diameter at the bottom thereof than at the top thereof.

The outside of the lower portion 10*h* of the housing 10*a* is, in a preferred embodiment, substantially circular in shape and is smaller in diameter at the bottom thereof than at the top thereof.

A vent passageway 10*k* extends through the housing 10*a* from the bottom thereof to the top thereof for allowing air to escape there through from the container 12 or 112 to atmosphere as liquid is poured into the container 12 or 112 through the funnel 11 and the adapter housing 10*a*. This prevents "burping" of air out the top of the container 12 or 112 as will happen if no vent is provided.

The vent passageway, in the preferred embodiment, extends the entire way from the tapered opening 10*e* radially outwardly to the outside of the housing 10*a* from top to bottom.

It is also noted that the adapter, in its preferred embodiment, extends around the longitudinal axis 10*d* by less than 360 degrees, whereby a vent passageway 10*k* is formed between an interior portion of the container 12 or 112 and atmosphere.

Obviously many modifications and variations of the present invention are possible in light of the above teachings. It is therefore to be understood that, within the scope of the appended claims, the invention may be practiced otherwise than as specifically described.

I claim:

1. An adapter for use with a funnel having an upper tapered section and a lower tapered section, and a container having a top surface with an opening therein, the adapter comprising:

a housing having a top, a bottom, a longitudinal axis, a tapered opening disposed through the inside housing about the longitudinal axis and an outside portion, said tapered opening being larger at the top thereof than at than at the bottom for telescopically receiving the lower tapered section of the funnel, said lowered tapered section of the funnel being disposed inside of the tapered opening in an operative position thereof and said lower tapered section of the funnel being disposed outside of said tapered opening when not in said operative position thereof, said funnel being separate from the adapter whereby the funnel can be separated from the adapter;

an upper portion of the housing that is disposed radially outwardly farther from the longitudinal axis than a lower portion of the housing is spaced outwardly from the longitudinal axis;

an intermediate portion of the housing that is disposed outwardly farther from the longitudinal axis than the lower portion of the housing but is does not extend radially outwardly more than the upper portion extends outwardly from the longitudinal axis;

a lower part of the upper portion having a first shoulder thereof thereon for abutment with the top surface of the container if the opening in the top surface of the container is smaller than the top portion but larger than the lower and intermediate portions of the housing; and a lower part of the intermediate portion having a second shoulder thereon for abutment with the top surface of the container if the opening in the top surface of the container is smaller than the lower portion of the housing but larger than the lower portion of the housing.

2. The adapter of claim 1 wherein at least a portion of the outside of the housing is substantially circular in shape.

3. The adapter of claim 1 wherein the outside of the intermediate portion of the housing is substantially circular in shape and is smaller in diameter at the bottom thereof than at the top thereof.

4. The adapter of claim 1 wherein the outside of the lower portion of the housing is substantially circular in shape and is smaller in diameter at the bottom thereof than at the top thereof.

5. The adapter of claim 1 including a vent passageway extending through the housing from the bottom thereof to the top thereof for allowing air to escape there through from the container to atmosphere as liquid is poured into the container through the funnel and the adapter housing.

6. The adapter of claim 5 wherein the vent passageway extends the entire way from the tapered opening radially outwardly to the outside of the housing from top to bottom.

7. The adapter of claim 1 wherein said adapter extends around the longitudinal axis by less than 360 degrees, whereby a vent passageway is formed between an interior portion of the container and atmosphere.

* * * * *